US005164253A

United States Patent [19]

Greak

[11] Patent Number: 5,164,253

[45] Date of Patent: Nov. 17, 1992

[54] WATER REPELLENT FABRICS

[75] Inventor: John L. Greak, Houston, Tex.

[73] Assignee: Shell Oil Company, Houston, Tex.

[21] Appl. No.: 783,670

[22] Filed: Oct. 28, 1991

Related U.S. Application Data

[62] Division of Ser. No. 473,023, Jan. 31, 1990.

[51] Int. Cl.[5] ..... B32B 7/00

[52] U.S. Cl. ..... 428/245; 428/260; 428/263; 428/265; 428/267; 428/289; 428/290; 428/913

[58] Field of Search ..... 428/289, 290, 260, 263, 428/265, 267, 272, 245, 913

[56] References Cited

U.S. PATENT DOCUMENTS

| | | | |
|---|---|---|---|
| 3,038,821 | 6/1962 | Wright et al. | 117/143 |
| 3,231,635 | 1/1966 | Holden | 260/880 |
| 3,700,633 | 10/1972 | Wald | 260/880 B |
| 3,821,172 | 6/1974 | Sugiura et al. | 260/78.5 R |
| 3,981,807 | 9/1976 | Raynolds | 252/8.8 |
| 4,101,492 | 7/1978 | Lindemann et al. | 260/29.6 NR |
| 4,128,675 | 12/1978 | Rossler et al. | 427/390 E |
| 4,141,847 | 2/1979 | Kiovsky | 252/51.5 |
| 4,194,041 | 3/1980 | Gore et al. | 428/315 |
| 4,287,261 | 9/1981 | West et al. | 428/421 |
| 4,391,949 | 7/1983 | St. Clair | 525/99 |
| 4,429,000 | 1/1984 | Naka et al. | 428/38 |
| 4,578,429 | 3/1986 | Gergen et al. | 525/291 |
| 4,617,057 | 10/1986 | Plueddemann | 106/2 |
| 4,678,681 | 7/1987 | Obayashi et al. | 427/38 |
| 4,696,830 | 9/1987 | Obayashi et al. | 427/41 |
| 4,783,503 | 11/1988 | Gergen et al. | 525/66 |
| 4,801,493 | 1/1989 | Ferziger et al. | 428/268 |

FOREIGN PATENT DOCUMENTS

| | | |
|---|---|---|
| 39728W/24 | 11/1973 | Denmark . |
| 60-181366A | 9/1985 | Japan . |
| 88/01570 | 3/1988 | PCT Int'l Appl. . |
| 1427488 | 3/1976 | United Kingdom . |
| 1473667 | 5/1977 | United Kingdom . |
| 2142556A | 6/1983 | United Kingdom . |

OTHER PUBLICATIONS

Vinyl Graft Polymerization-Induced Modification of Some Properties of Poly(ethylene Terephthalate) Fabric, A. Hebeish et al., 1982.

Radiation Grafting to Poly(ethylene terephthalate) Fibres, T. Memetea & V. Stannett, Polymer, Apr. 1979, pp. 465–468.

Chemical Structure of Poly(ethylene Terephthalate)-Styrene and Nylon Styrene Graft Copolymers, I. Sakurada et al., J. Polymer Sci., 1973.

*Primary Examiner*—James J. Bell

[57] ABSTRACT

A water repellant fabric and a process to produce that fabric is provided. The process comprises; providing a fabric substrate having sites reactive with polymeric functional groups; contacting the fabric substrate with a functional group containing polymer; removing unreacted functional group containing polymer; and recovering a water repellent fabric. The appearance, stiffness and texture of the treated fabric is similar to the untreated fabric and the hand of the treated fabric is excellent.

6 Claims, No Drawings

WATER REPELLENT FABRICS

This is a division of application Ser. No. 07/473,023, filed Jan. 31, 1990.

BACKGROUND

This invention relates to a water repellent fabric and to a process to produce a water repellent fabric.

Water repellent treatments in the prior art include polysiloxanes such as those taught in U.S. Pat. Nos. 3,038,821 and 4,287,261. Such water repellent treatments result in a wash-fast treatment which permits the treated fabric to breathe, but require relatively expensive polymers as starting materials. Other water repellents known in the art include waxes, aluminum soaps, zirconium salts, quaternary ammonium salts, N-methlol fatty acid amides, diisocyanates and triisocyanates. These treatments have a variety of shortcomings which include high cost, and degradation of fabric softness and texture.

Rubbers, such as butyl rubbers, isoprene rubbers, and block copolymers of styrene and conjugated diolefins, are known as treatments for fabrics, but they have generally been used to provide a waterproof coating treatment which does not allow the fabric to breathe. Such coating is described in U.S. Pat. No. 4,696,830. Coating a fabric with rubber alters the surface texture of the fabric and makes the fabric stiff and uncomfortable to wear. Rubber coated fabrics therefore are not acceptable as a water repellent treatment. When the treated fabric must have a soft texture and a good feel to skin. This good feel to skin is commonly referred to as a good "hand".

It is an object of this invention to provide a process to treat fabric utilizing functional group containing hydrophobic elastomeric polymer which results in a water repellent fabric having an excellent hand. It is a further objective of this invention to provide this process wherein the treatment is not removed by repeated detergent washings. In another aspect, it is an object of this invention to provide a water repellent fabric with an excellent hand wherein repeated washings does not remove the water repellent nature of the fabric.

SUMMARY OF THE INVENTION

The objects of the present invention are accomplished by providing a fabric substrate, the fabric substrate having sites that are reactive with polymeric functional groups; contacting the fabric substrate with a functional group containing hydrophobic elastomeric polymer; removing unreacted polymer; and recovering a water repellent fabric.

In a preferred embodiment, the functional group containing polymer is a functionalized block copolymer of a conjugated diolefin and a vinyl aromatic which has been selectively hydrogenated to remove 98 percent of the initial ethlyenic unsaturation and less than 2 percent of the initial aromatic unsaturation, the functionality is selected from the group consisting of anhydride, acid, epoxy, amine, isocyanate and ester, and the fabric is selected from the group consisting of wool, rayon and cotton.

The appearance, stiffness and texture of the treated fabric is similar to the untreated fabric and the hand of the treated fabric is excellent.

DETAILED DESCRIPTION OF THE INVENTION

The fabrics which may be treated by the present invention are those fabrics which are reactive with polymeric functional groups. Examples include wool, rayon, and cotton, which are reactive with anhydride, acid, epoxy, amine, isocyanate and ester functionality, polyesters which is reactive with anhydride, acid, epoxy and ester functionality, and nylon, which is reactive with anhydride, acid and epoxy functionality. These fabrics may be natural, such as wool or cotton, artificial, such as nylon or polyester, or blends thereof. A fabric which is reactive may also be blended with a fabric which is not reactive and treated by the process of this invention.

The fabric may be a woven fabric or a non-woven fabric.

The reactive nature of the fabric substrate with respect to a particular functional group is determined by contacting the fabric substrate with a polymer containing that functional group for 5 minutes at a temperature of 90° C., with the functional group containing polymer in a solution of about 10 percent by weight or more in a sutiable solvent, and then rinsing the fabric with the suitable solvent. The fabric substrate is considered to be reactive with the polymeric functionality if the rinse does not remove substantially all of the functionalized polymer from the fabric substrate. The amount of the functional group containing polymer which must remain with the fabric substrate in order for the fabric substrate to be considered to have reactive sites is about 0.05 percent by weight or greater based on the treated fabric. The nature of the reaction between the substrate and the polymer is not limiting, and the reaction may therefore be ionic, covalent or otherwise. The effect of the required reaction is only that the functionalized polymer is not removed from the fabric by rinsing with the solvent for the polymer.

The functional group containing polymer may be prepared by grafting functional groups to the unfunctionalized polymer. Alternatively, the polymer may be prepared by copolymerizing functional group containing monomers with other monomers to product the functional group containing polymer. The base polymer must therefore be hydrophobic, elastomeric, and either initially contain functional groups, or be graftable with functional groups. Acceptable polymers include acrylic rubbers, butadiene rubbers, isoprene rubbers, isobutylene rubbers, ethylene-propylene-diene rubbers (EPDM), butadiene-acrilonitrile rubbers, urethane rubbers, ethylene vinylacetate rubbers, styrene-butadiene rubbers and block copylmer rubbers of styrene and conjugated diolefins. These polymers are each known in the art, and are commercially available from many sources.

Where these polymers contain ethylenic unsaturation, the ethylenic unsaturation may of course be eliminated by hydrogenation. Hydrogenation of ethylenic unsaturation improves the polymers oxidative and U.V. stability and therefore can improve the treated fabric's color stability. Hydrogenation is therefore preferred.

Although a wide range of elastomeric polymers are operative as the base polymer of this invention, block copolymers of conjugated diolefins are preferred. The preferred base polymer may include other types of monomer units to form block, tapered or random copolymers.

The preferred base polymer is most preferably a block copolymer which comprises at least one block which comprises predominantly vinyl aromatic monomer units and at least one block which comprises, before hydrogenation, predominantly conjugated diolefin monomer units. The blocks may comprise other monomer units but must comprise about 85% or more of the type of monomer unit which characterizes the block. Such blocks may be tapered, random, or sequential copolymer blocks.

The preferred base polymers are typically prepared by anionic polymerization in an inert hydrocarbon solvent by adding a secondary or tertiary lithium alkyl initiator to the solvent and then sequentially adding monomers to form individual blocks. After the blocks are formed the polymers are either terminated by addition of alcohol or water or coupled by addition of carbon dioxide or divinyl benzene. Preparation of linear block copolymers is taught by U.S. Pat. No. 3,231,635 which is incorporated herein by reference.

The preferred base polymer may have a star configuration. Block copolymers which are of the star configuration may have arms which have the same configuration or arms which vary in configuration. Star configuration block copolymers may be synthesized using a polyvalent initiator or may be synthesized by adding a coupling agent, such as divinyl benzene, to a solution of synthesized arms. Synthesis of star configuration block copolymers is taught by U.S. Pat. Nos. 4,391,949 and 4,141,847 which are incorporated herein by reference.

The preferred base polymers may be hydrogenated so as to saturate more than 80% of the original ethylenic unsaturation. Hydrogenation is preferred due to the significant improvement in oxidative and U.V. stability imparted by hydrogenation of ethylenic unsaturation. This improved U.V. and oxidative stability results in treated fabrics which have improved color stability. The ethylenic unsaturation is preferably reduced by 95% of the original ethylenic unsaturation and more preferably more than 98%. When aromatic unsaturation is present in the base polymer, hydrogenation will preferably be selective. By selective hydrogenation, it is meant that aromatic unsaturation will remain after hydrogenation. Preferably, 90% of the original aromatic unsaturation will be retained after hydrogenation and more preferably, 98% of the original aromatic unsaturation will remain. A preferred hydrogenation process is taught in U.S. Pat. No. 3,700,633 which is incorporated herein by reference.

The preferred base polymers useful in the present invention have number average molecular weights within the range of about 12,000 to about 700,000, and most preferably within the range of about 12,000 to about 270,000. Number average molecular weights and determined by gel permeation chromatography.

In the most preferred embodiment, the vinyl aromatic content of the base polymer is between about 2 percent by weight of the polymer and about 60 percent by weight of the polymer. Higher vinyl aromatic contents result in a polymer which is not elastomeric.

The functional groups which are grafted to the base polymers are selected from those which are reactive with the fabric to be treated. When the fabric is either cotton, wool or rayon functional groups which are operative include acids, anhydrides, epoxies, amines, isocyanates and esters. these groups are reactive with the pendent hydroxyl groups which are known to be present on this group of fabrics. When the fabric to be treated is polyester, functional groups which are acceptable include anhydride, acid and epoxy because these functional groups are known to be reactive with the amine groups of the nylons.

The amount of functionality required to result in a treated fabric which is water repellent varies, but at least one functional group is required per polymer molecule in all cases in order to provide a group reactive with the fabric substrate reactive site. Preferably, the amount of functionality will be between about 0.1 percent by weight and about 5.0 percent by weight based on the functionalized polymer.

The preferred base copolymer of vinyl aromatics and conjugated diolefins may contain functionality in either the vinyl arene blocks, the conjugated diolefin blocks, or both. This is because the purpose of the functionality is simply to attach the block copolymer to the fabric.

Grafting of a variety of functional groups to the vinyl aromatic blocks of vinyl aromatic-conjugated diolefin block copolymers is taught in U.S. Pat. No. 4,783,503 which is incorporated herein by reference. Grafting primarily to the vinyl aromatic blocks is accomplished according to the method taught in '503 by first reacting the block copolymers with a metal alkyl in the presence of a polar metallation promoter such as tetramethylethylene diamine. The metal ion is then replaced with a reactive functional group such as carbon dioxide, ethylene oxide, aldehydes, ketones, carboxylic acid salts, their esters and halides, epoxides, sulfur, boron alkoxides, isocyanates and various silicon compounds.

Functional groups may be grafted to polymers containing ethylenic unsaturation by free radical or thermal grafting of unsaturated monomers which contain the functionality. A free radical initiator such as 2,5-dimethyl-2,5-di(t-butyl peroxy)hexane (available commercially under the trade name Lupersol 101), may be utilized to catalyze the grafting or the grafting may be accomplished thermally. Free radical initiated grafting, such as that taught in U.S. Pat. No. 4,578,429, incorporated herein by reference, is preferred. This grafting may be accomplished by melt mixing the polymer, functional group containing monomer and, optionally, the free radical initiator under high shear conditions, such as in an extruder. Alternatively, the components may be solution grafted. Solution grafting is taught in U.S. Pat. No. 4,141,847 which is incorporated herein by reference.

The treated fabric of the present invention will comprise from about 0.05 to about 2.0 percent by weight of functional group containing polymer, based on the treated fabric. Higher levels of functional group containing polymers tend to adversely effect the feel, texture and stiffness of the fabric by making the treated fabric feel rubbery and stiff. Lesser amounts of functionalized hydrogenated polymer will not be effective in imparting water repellency.

The functional group containing polymer is contacted with the fabric under conditions effective to react an effective amount of the functional groups with the fabric material. The functionalized polymers may be contacted with the fabric in a solution with an inert hydrocarbon solvent, such as toluene. In general, contact at a temperature of 90° C. or greater for 5 minutes or more is generally sufficient.

In a preferred embodiment of the invention, the functionalized polymer is contacted with the fabric with the polymer dissolved in an inert solvent. Solvents such as xylene, toluene, cyclohexane, aliphatic hydrocarbons, chlorinated hydrocarbons and tetrahydrofuran are acceptable for most of the operative polymers.

Contacting of the fabric with the functionalized block copolymer may alternatively be achieved with the polymer in an aqueous emulsion.

It is critical in the present invention that unreacted functional group containing polymer be removed from the fabric after the initial contacting of the polymer and the fabric. In a preferred embodiment this is accomplished by dipping the fabric in a solvent. Most preferably, the fabric is dipped in the solvent at least twice to ensure removal of polymer which is not reacted with the fabric. The solvent may be, and preferably is, the same solvent as that described above as the solvent for the polymer. Solvents such as xylene, toluene, cyclohexane, aliphatic hydrocarbons, chlorinated hydrocarbons and tetrahydrofuran are therefore generally acceptable.

Fabric treated according to the process of this invention has essentially the softness, texture, feel and hand of the fabric before treatment. The treated fabric is permeable to vapors and thus allows evaporation of perspiration under the surface of the treated fabric. The treted fabric is water repellent and the water repellency is substantially retained after multiple detergent washings. When the elastomeric polymer employed has been hydrogenated to remove ethylenic unsaturation, the treated fabric has excellent color stability. The treatment according to this invention also improves wind resistance and the ease of removing soil, particularly polar soil.

EXAMPLES

Functionalized, hydrogenated block copolymers were prepared with maleic anhydride, glycidyl acrylate and acrylic acid functionality. The base block copolymer for each was a 50,000 molecular weight polystyrenepolybutadiene-polystyrene block copolymer having about equal sized polystyrene endblocks. The base block copolymer was about 30% by weight polystyrene. The base block copolymer was selectively hydrogenated, saturating more than 98% of the original ethylenic unsaturation while more than 98% of the original aromatic unsaturation remained. The functionality was incorporated by extruder grafting maleic anhydride, glycidyl acrylate and acrylic acid to separate portions of the base block copolymer utilizing 2,5-dimethyl-2,5-di(t-butyl peroxy)hexane as a free radical initiator. The level of functionality for the maleic anhydride, glycidyl acrylate and acrylic acid modified block copolymers was 2.0, 1.4 and 0.9 percent by weight respectively.

Samples of nylon, polyester and cotton were each treated with the three functionalized block copolymers. As a control, a sample of each of the three fabrics was treated with unfunctionalized base block copolymer. The samples were treated by dissolving 1.5 grams of each block copolymer in 400 mls of toluene. The solutions were then heated to 90° C. The fabric samples were then placed in the hot solutions for 5 minutes and then removed and dried. The samples were then rinsed in fresh toluene three times to remove unreacted block copolymer. The samples were then dried and tested for water repellency.

To test for water repellency, water was dropped onto the surface of the fabric from an eye dropper. The drop of water will either stay on the fabric as a bead, or be pulled into the fabric by capillary action, which is referred to as being "wicked" into the fabric. If the fabric has good water repellency, the water will stay on the surface of the fabric in a bead. A sample without good water repellency would wick the drop into the fabric almost immediately. Samples treated with unfunctionalized block copolymer showed no improvement in water repellency over the untreated fabrics. The water immediately wicked into the fabric. Water "beaded" into a drop on the surface of the fabrics which were treated with functionalized block copolymers with the exception of the nylon sample treated with glycidyl acrylate functionalized block copolymer. Nylon is not expected to be reactive with ester such as glycidyl acrylate, and the lock of effectiveness of glycidyl acrylate functionalized block copolymer as a water repellent treatment for nylon fabrics is therefore expected. The relative water repellency of the treated samples varied, as measured by the time required for the beaded water droplet to "wick" into the fabrics. The relative order of the water repellency is listed in Table 1 for the different samples.

Sample 1, which was treated with maleic anhydride functionalized block copolymer, was then washed in a hot laundry detergent solution three times. After these three washings, the sample still had excellent water repellency.

TABLE 1

| Sample No. | Fabric | Functionality | Repellency |
|---|---|---|---|
| 1 | Cotton | Maleic Anhydride | Most |
| 2 | " | Acrylic Acid | |
| 3 | " | Glycidyl Acrylate | Least |
| 4 | " | Base Block Copolymer | None |
| 5 | Nylon | Acrylic Acid | Most |
| 6 | " | Maleic Anhydride | Least |
| 7 | " | Glycidyl Acrylate | None |
| 8 | " | Base Block Copolymer | None |
| 9 | Polyester | Glycidyl Acrylate | Most |
| 10 | " | Acrylic Acid | |
| 11 | " | Maleic Anhydride | Least |
| 12 | " | Base Block Copolymer | None |

I claim:

1. A water repellent fabric comprising: a fabric substrate having reactive sites; and a functional group containing hydrophobic elastomeric polymer which is not removable from the fabric by toluene rinses wherein the functional group containing polymer comprises monomer units of conjugated diolefins and wherein the functionality is reactive with the fabric reactive sites.

2. The fabric of claim 1 wherein the fabric comprises material selected from the group consisting of cotton, wool, and rayon and the functional groups are selected from the group consisting of anhydride, acid, epoxy, amine, isocyanate, and ester.

3. The fabric of claim 1 wherein the fabric is a polyester and the functional groups are selected from the group consisting of anhydride, acid, epoxy and ester functional groups.

4. The fabric of claim 1 wherein the fabric is a nylon fabric and the functional groups are selected from the group consisting of acid, anhydride and epoxy functional groups.

5. The fabric of claim 1 wherein the functional group containing polymer is a functionalized hydrogenated block copolymer comprising at least one block which comprises predominantly vinyl aromatic monomer units and at least one block which comprises, before hydrogenation, predominantly conjugated diolefin monomer units.

6. The fabric of claim 5 wherein the polymeric functionality is predominantly grafted to the blocks which comprise, before hydrogenation, predominately conjugated diolefin monomer units.

* * * * *